US007966853B2

(12) United States Patent
Maier-Hunke

(10) Patent No.: US 7,966,853 B2
(45) Date of Patent: Jun. 28, 2011

(54) KEY CARRIER

(75) Inventor: Horst-Werner Maier-Hunke, Iserlohn (DE)

(73) Assignee: "Durable" Hunke & Jochheim GmbH & Co. KG, Iserlohn (DE)

( * ) Notice: Subject to any disclaimer, the term of this patent is extended or adjusted under 35 U.S.C. 154(b) by 259 days.

(21) Appl. No.: 10/569,060

(22) PCT Filed: Sep. 3, 2004

(86) PCT No.: PCT/EP2004/009977

§ 371 (c)(1),
(2), (4) Date: Feb. 22, 2006

(87) PCT Pub. No.: WO2005/023039

PCT Pub. Date: Mar. 17, 2005

(65) Prior Publication Data

US 2007/0022794 A1 Feb. 1, 2007

(30) Foreign Application Priority Data

Sep. 4, 2003 (DE) ..... 103 41 496

(51) Int. Cl.
*A44B 19/24* (2006.01)
*E05B 19/24* (2006.01)

(52) U.S. Cl. ..... 70/456 R; 70/460; 206/37.1; D3/207

(58) Field of Classification Search ..... 70/456 R, 70/457, 459, 460; 206/37.1–37.8; D3/207–212; 403/62, 152, 162, 163
See application file for complete search history.

(56) References Cited

U.S. PATENT DOCUMENTS

| | | | | | |
|---|---|---|---|---|---|
| 1,066,129 | A | * | 7/1913 | Manasse | 70/456 R |
| 1,255,870 | A | * | 2/1918 | Foster | 63/19 |
| 1,835,793 | A | * | 12/1931 | Lurie | 70/456 R |
| 1,984,069 | A | * | 12/1934 | Larter | 70/456 R |
| 2,218,932 | A | | 10/1940 | Collins | |
| 2,422,436 | A | * | 6/1947 | Plaud | 70/456 R |
| 2,554,303 | A | * | 5/1951 | Longhenrich | 70/457 |
| 2,559,946 | A | * | 7/1951 | Craig et al. | 70/456 R |
| 2,627,743 | A | * | 2/1953 | Ribbing | 70/456 R |
| 3,618,346 | A | * | 11/1971 | Humphery | 70/456 R |

(Continued)

FOREIGN PATENT DOCUMENTS

DE 8521845 9/1985

(Continued)

OTHER PUBLICATIONS

Merriam-Webster's Collegiate Dictionary, 2000, Merriam-Webster, Inc., 10th edition, p. 880.*

*Primary Examiner* — Peter M Cuomo
*Assistant Examiner* — Christopher Boswell
(74) *Attorney, Agent, or Firm* — Mark P. Stone

(57) ABSTRACT

The invention relates to a key carrier comprising a base body (1) and a window, wherein one respective end of the base body (1) and window (6) is provided with a fork-shaped termination. A key ring (21) can be introduced into a gap (18) defined by the prongs (10,11) of the fork-shaped end of the window (6). When inserted, said key ring is secured by means of a retaining bolt (14). The prongs (10,11) of the window can be clipped in between the prongs (2,3) of the base body. When clipped in, the window is retained by pivoting journals (16, 17) which engage with the opposite ends of the window bores (12,13) receiving the retaining bolts (14).

20 Claims, 1 Drawing Sheet

U.S. PATENT DOCUMENTS

| | | | | | |
|---|---|---|---|---|---|
| 3,813,907 | A | * | 6/1974 | Jones et al. | 70/456 R |
| 3,877,269 | A | * | 4/1975 | Dehart | 70/456 R |
| 3,908,418 | A | * | 9/1975 | Stoffel | 70/456 R |
| 4,348,880 | A | * | 9/1982 | Toyoda | 70/456 R |
| 4,959,983 | A | * | 10/1990 | Hsu | 70/456 R |
| 5,033,141 | A | * | 7/1991 | Kang | 70/456 R |
| 5,177,989 | A | * | 1/1993 | Stillwagon | 70/456 R |
| 5,291,768 | A | * | 3/1994 | Rieffel et al. | 70/456 R |
| 5,414,948 | A | * | 5/1995 | Kudo | 63/19 |
| 5,511,390 | A | * | 4/1996 | Mah | 63/19 |
| 5,713,147 | A | * | 2/1998 | Johnson | 40/771 |
| 5,950,287 | A | * | 9/1999 | Cacciatore et al. | 63/19 |
| 6,357,153 | B1 | * | 3/2002 | Gelardi et al. | 70/456 R |
| 6,427,487 | B1 | * | 8/2002 | Morgan | 63/19 |
| 2003/0002277 | A1 | | 1/2003 | Lu | |
| 2003/0167810 | A1 | * | 9/2003 | Frias et al. | 70/456 R |
| 2007/0151315 | A1 | * | 7/2007 | Vincent | 70/456 R |

FOREIGN PATENT DOCUMENTS

| | | |
|---|---|---|
| DE | 10117928 | 10/2002 |
| FR | 1443390 | 5/1966 |
| GB | 2319055 | 5/1998 |

* cited by examiner

KEY CARRIER

TECHNICAL FIELD

The invention relates to a key carrier comprising a basic body and a window-covered receiving pocket for an information carrier which serves for the identification of the particular key attached to the carrier.

PRIOR ART

Key carriers of the above type are known in which the basic body is designed in the manner of a frame comprising a rear wall, and an information carrier, which is routinely formed by a cardboard strip, and a transparent rigid film strip which serves to protect the information carrier are able to be inserted into said frame from a narrow side. In the region of two mutually opposite sides of the basic body, the latter has a respective hole, one of which serves for hanging up the key carrier and one of which serves for receiving a keyring or an intermediate element having a figure-of-eight form, which keyring or intermediate element can simultaneously be used to secure the position of the information carrier and the position of the window-forming rigid film strip in the basic body (cf. SCHÄFER SHOP main catalog 2003/2004, page 559).

SUMMARY OF THE INVENTION

The known key carriers are unable to provide complete satisfaction for a number of reasons. A prime reason is that the edge of the hole intended for receiving the keyring is comparatively highly stressed and the guidance of the keyring or of the intermediate element through the routinely narrow hole wall leaves something to be desired. A first object of the invention is to overcome this deficiency, said object being achieved in the case of a key carrier of the type under consideration in that one of its ends is designed in the manner of a fork between whose prongs is arranged a retaining pin for a keyring. The key carrier according to the invention provides the advantage that with it the fork can be used for guidance purposes, while the retaining pin is assigned merely a supporting function.

It proves to be expedient if both the basic body and the window have ends designed in the manner of forks, since a corresponding design forms the precondition for a pivotable arrangement of the window on the basic body. Such an arrangement has the advantage that the window can be swung open for the purpose of introducing and removing an information carrier, thereby appreciably facilitating in particular the exchange of information carriers.

The prongs of the fork-shaped end of the basic body advantageously enclose the prongs of the fork-shaped end of the window that is provided with bores for receiving the retaining pin.

Attaching the keyring to the key carrier proves to be an awkward operation in the case of the known key carriers because the keyring, which routinely consists of two turns of spring-steel wire, has as it were to be screwed into the hole in the carrier which serves to receive it or into an eye of the intermediate element after one end of the wire has been pulled away from the remainder of the ring beforehand. This disadvantage can be eliminated in the key carrier according to the invention by the retaining pin being mounted so as to be axially displaceable in bores of at least one pair of prongs. Consequently, by displacing the retaining pin it is possible to open the gap which is defined by adjacent prongs and serves for receiving a keyring, to introduce the keyring into the gap and then to introduce the retaining pin into the keyring by pushing said retaining pin back into its original position.

It has proved to be particularly advantageous if the window and the basic body are releasably connected to one another and the prongs of the fork-shaped end of the basic body are provided at their mutually facing sides with pivot journals which can be introduced into the bores of the prongs of the fork-shaped end of the window. In such a case, following connection of the basic body to the window, the retaining pin is secured by the pivot journals against sliding out of the bores in the prongs of the fork-shaped end of the window.

Handling the key carrier can be additionally facilitated by one of the pivot journals being connected via a joint to the retaining pin which is mounted so as to be axially displaceable in the bores of the prongs of the fork-shaped end of the window. Owing to the connection between the pivot journal and the retaining pin, the latter is automatically withdrawn from the bores of the prongs of the fork-shaped end of the window when separating the basic body from the window and pushed back into its initial position when reassembling the parts.

Known key carriers are routinely hung up on a single hook at their end which is remote from the keyring. This type of hanging results in the carrier and key forming a comparatively long unit which takes up a comparatively large amount of space in a key box or key cabinet. To reduce the space requirement, it is recommended to hang up the key carrier at the end at which the keyring also engages. To make such hanging possible, the key carrier according to the invention is provided in the region of its fork-shaped end with two lateral, preferably cylindrical, projections which serve for hanging it up between two adjacent hooks. In order, finally, to achieve an unimpeded view of the information carrier, it is recommended for the fork-shaped end of the key carrier to be slightly bent rearwardly with respect to its main part which receives the information carrier and in this way to create the precondition whereby the key which is to be stored can assume a position in the key box or key cabinet in which it is behind the key carrier.

In the region of the end which is remote from its fork-shaped end, the window can preferably be locked on the basic body by way of latching means, and the basic body is provided on its longitudinal sides with guide cheeks for the window.

Since the key carriers are obvious mass-produced articles, it is recommended for both the basic body and the window to be designed as plastic injection-molded parts and to use materials for their production which allow the prongs of the fork-shaped end of the basic body and/or of the window to widen in a springy and flexible manner.

Further details and features of the invention will be explained below with reference to the appended drawings of a preferred embodiment.

WAYS OF IMPLEMENTING THE INVENTION

Figure 1:
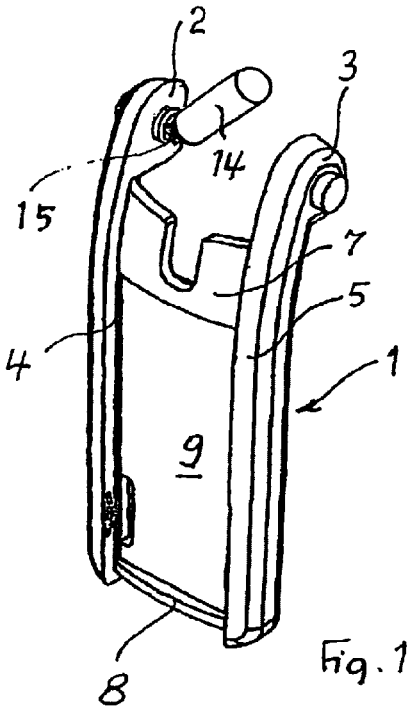
FIG. 1 shows a perspective view of the basic body of a key carrier.
Figure 2:
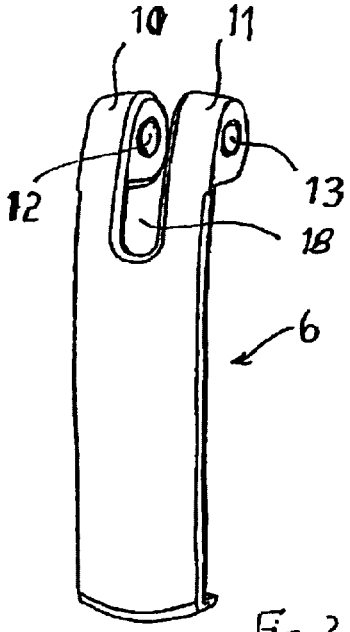
FIG. 2 shows a perspective view of the window for the key carrier according to FIG. 1.

In FIG. 1, the basic body of a key carrier consisting of two plastic injection-molded parts is generally denoted by 1. The material of the basic body 1 is preferably opaque, i.e. black for example. The upper, slightly rearwardly bent or angled end of the basic body 1 is designed in the manner of a fork having two prongs 2 and 3. The prongs 2 and 3 merge into guide cheeks 4 and 5 for the lateral guidance of a window 6, which is represented in FIG. 2. Situated between the guide cheeks 4 and 5 and an upper transverse web 7 and a lower transverse web 8 is a shallow pocket 9 for receiving an information carrier (not shown) for the identification of the respective key, the information carrier being routinely formed by a cardboard strip.

At its upper, likewise slightly rearwardly bent, end, the window 6, like the basic body 1, has two fork-forming prongs 10 and 11 which are provided with aligned bores 12 and 13.

The bores 12 and 13 of the window 6 serve for receiving a retaining pin 14 which is connected via a joint 15, which is designed in the manner of a film hinge, to one of two pivot journals 16 and 17 provided on the inner flanks of the prongs 2 and 3 of the basic body 1. The length of the retaining pin 14 is sufficiently large to bridge the gap 18 between the prongs 10 and 11 but smaller than the width of the window 6, with the result that the pivot journals 16 and 17 are likewise seated in the bores 12 and 13 of the window 6.

The prongs 2 and 3 of the basic body 1 have two cylindrical projections 19, 20 arranged on their sides which are opposite to the pivot journals 16, 17 and these projections can be used for hanging up the key carrier between a pair of adjacent hooks (not shown) of a key strip.

Figure 3:
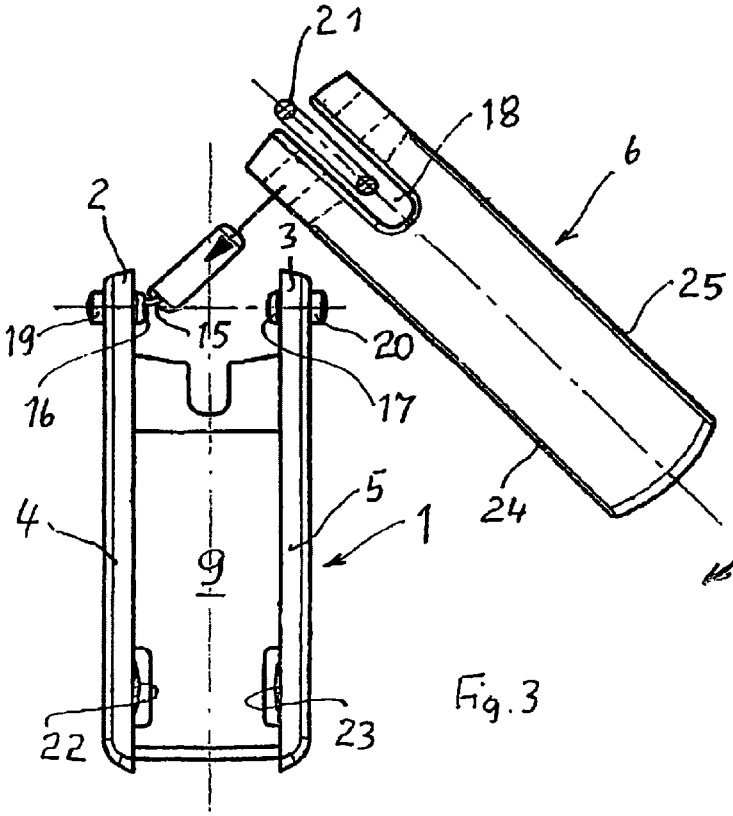
FIG. 3 shows the assembly between the basic body according to FIG. 1 and the window according to FIG. 2.
Figure 4:
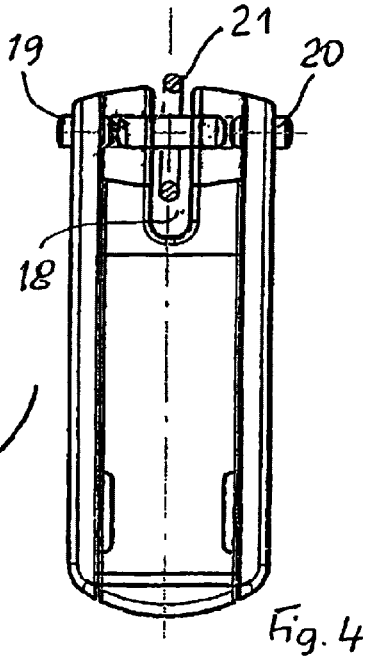
FIG. 4 shows a front view of the key carrier following assembly of its two parts.

As shown in FIG. 3, with the window separated from the basic body 1, it is possible even for a closed keyring 21 to be introduced into the gap 18 and then secured by the retaining pin 14. The elasticity of the material used for the production of the basic body 1 and the window allows the upper end of the window 6 to be pivoted without problem into the fork formed by the upper end of the basic body 1 so as then to assume the position represented in FIG. 4, in which said window can be locked by means of latching lugs 22 and 23 mounted on the guide cheeks 4 and 5, said lugs engaging over narrow ribs 24, 25 which are arranged on the mutually opposite longitudinal sides of the window 6.

The invention claimed is:

1. A key carrier comprising a basic body having a receiving pocket for an information carrier which serves for the identification of the particular key attached to the carrier, a cover defining a window formed from a transparent material cooperating with said basic body for covering said receiving pocket, said receiving pocket being defined only in said basic body, wherein one end of said key carrier is designed in the manner of a fork between whose prongs (2, 3; 10, 11) is arranged a substantially non-foldable retaining pin (14) for a keyring (21), and both the basic body (1) and the window (6) each have one fork-shaped end having prongs extending in a substantially longitudinal direction from the basic body and the window, respectively.

2. The key carrier as claimed in claim 1, characterized in that the window (6) is pivotally mounted on the basic body (1) in the region of the fork-shaped end of said window.

3. The key carrier as claimed in claim 2, characterized in that the retaining pin (14) is mounted so as to be axially displaceable in bores (12, 13) of at least one pair of said prongs (10, 11).

4. The key carrier as claimed in claim 2, characterized in that the window (6) and the basic body (1) are releasably connected to one another.

5. The key carrier as claimed in claim 1, characterized in that the retaining pin (14) is mounted so as to be axially displaceable in bores (12, 13) of at least one pair of said prongs (10, 11).

6. The key carrier as claimed in claim 1, characterized in that the window (6) and the basic body (1) are releasably connected to one another.

7. The key carrier as claimed in claim 6, characterized in that the prongs (2, 3) of the fork-shaped end of the basic body (1) are provided at their mutually facing sides with pivot journals (16, 17) which can be introduced into bores (12, 13) of the prongs (10, 11) of the fork-shaped end of the window (6).

8. The key carrier as claimed in claim 7, characterized in that one of the pivot journals (16) is connected via a joint (15) to the retaining pin (14) which is mounted so as to be axially displaceable in the bores (12, 13) of the prongs (10, 11) of the fork-shaped end of the window (6).

9. The key carrier is claimed claim 1, characterized in that it is provided in the region of its fork-shaped end with lateral projections (19, 20) which serve for hanging it up between two adjacent hooks.

10. The key carrier as claimed in claim 9, characterized in that the projections (19, 20) are cylindrical.

11. The key carrier as claimed in claim 10, characterized in that its fork-shaped end is bent rearwardly with respect to its main part which receives the information carrier.

12. The key carrier as claimed in claim 9, characterized in that its fork-shaped end is bent rearwardly with respect to its main part which receives the information carrier.

13. The key carrier as claimed in claim 1, characterized in that in the region of the end which is remote from its fork-shaped end, the window (6) can be locked on the basic body (1) by way of latching means (22, 23).

14. The key carrier as claimed in claim 1, characterized in that the basic body (1) is provided on its longitudinal sides with guide cheeks (4, 5) for the window.

15. The key carrier as claimed in claim 1, characterized in that the basic body (1) and the window (6) are designed as plastic injection-molded parts.

16. The key carrier as claimed in claim 15, characterized in that the prongs (2, 3; 10, 11) of the fork-shaped end of the basic body are designed to be springy and flexible.

17. The key carrier as claimed in claim 15, characterized in that the prongs (2, 3; 10, 11) of the fork-shaped end of the window (6) are designed to be springy and flexible.

18. A key carrier comprising a basic body having a receiving pocket for an information carrier which serves for the identification of the particular key attached to the carrier, a cover defining a window formed from a transparent material cooperating with said basic body for covering said receiving pocket, the window and the basic body being releasably connected to one another, said receiving pocket being defined only in said basic body, wherein one end of said key carrier is designed in the manner of a fork between whose prongs (2, 3; 10, 11) is arranged a substantially non-foldable retaining pin (14) for a keyring (21), and both the basic body (1) and the window (6) each have one fork-shaped end having prongs extending in a substantially longitudinal direction from the basic body and the window, respectively; the prongs (2,3) of the fork-shaped end of the basic body (1) being provided at their mutually facing sides with pivot journals (16, 17) which can be introduced into bores (12, 13) of the prongs (10, 11) of the fork-shaped end of the window (6), one of the pivot journals (16) being connected via a joint (15) to the retaining pin (14) which is mounted so as to be axially displaceable in the bores (12, 13) of the prongs (10, 11) of the fork-shaped end of the window (6), the retaining pin (14) and the pivot journal (16) connected thereto consisting of plastic and the joint being formed by a plastic bridge which forms one piece with the retaining pin (14) and the pivot journal (16).

19. A key carrier comprising a basic body having a receiving pocket for an information carrier which serves for the identification of the particular key attached to the carrier, a cover defining a window formed from a transparent material cooperating with said basic body for covering said receiving pocket, said receiving pocket being defined only in said basic body, wherein one end of said key carrier is designed in the manner of a fork between whose prongs (2, 3; 10, 11) is arranged a substantially non-foldable retaining pin (14) for a keyring (21), both the basic body (1) and the window (6) each having one fork-shaped end having prongs extending in a substantially longitudinal direction from the basic body and the window, respectively; the window (6) defining therein a gap (18), said gap arranged between said prongs (10, 11) extending from said window for receiving the key ring (21), the retaining pin (14) bridging the gap (18).

20. A key carrier comprising a basic body having a receiving pocket for an information carrier which serves for the identification of the particular key attached to the carrier, a cover defining a window formed from a transparent material cooperating with said basic body for covering said receiving pocket, said receiving pocket being defined only in said basic body, wherein one end of said key carrier is designed in the manner of a fork between whose prongs (2, 3; 10, 11) is arranged a substantially non-foldable retaining pin (14) for a key ring (21), both the basic body (1) and the window (6) each having one fork-shaped end having prongs extending in a substantially longitudinal direction from the basic body and the window, respectively; the prongs (2, 3) of the fork-shaped end of the basic body (1) enclosing the prongs (10, 11) of the fork-shaped end of the window (6), the fork-shaped end of the window (6) defining therein bores (12, 13) for receiving the retaining pin (14).

* * * * *